United States Patent [19]

Abe

[11] Patent Number: 4,733,357

[45] Date of Patent: Mar. 22, 1988

[54] LEARNING CONTROL SYSTEM FOR CONTROLLING AN AUTOMOTIVE ENGINE

[75] Inventor: Kunihiro Abe, Higashimurayama, Japan

[73] Assignee: Fuji Jukogyo Kabushiki Kaisha, Tokyo, Japan

[21] Appl. No.: 753,845

[22] Filed: Jul. 11, 1985

[30] Foreign Application Priority Data

Jul. 13, 1984 [JP] Japan ..... 59-146649

[51] Int. Cl.[4] ..... F02M 17/00

[52] U.S. Cl. ..... 364/431.04; 364/431.05; 123/489

[58] Field of Search ..... 364/431.05, 431.04; 123/440, 489; 60/276, 285

[56] References Cited

U.S. PATENT DOCUMENTS

| | | | |
|---|---|---|---|
| 4,235,204 | 11/1980 | Rice | 60/276 |
| 4,430,976 | 2/1984 | Kondo et al. | 123/489 |
| 4,445,481 | 5/1984 | Aoki et al. | 123/489 |
| 4,539,958 | 9/1985 | Ito et al. | 123/440 |
| 4,546,747 | 10/1985 | Kobayashi et al. | 123/489 |
| 4,616,619 | 10/1986 | Saito et al. | 123/489 |

FOREIGN PATENT DOCUMENTS 0122135 7/1982 Japan .

*Primary Examiner*—Parshotam S. Lall
*Attorney, Agent, or Firm*—Martin A. Farber

[57] ABSTRACT

A system for updating data stored in a table at a steady state of engine operation in accordance with a feedback signal. At the first updating, the data is entirely updated with the feedback signal, and thereafter the data is incremented and decremented with a minimum value, when the feedback signal deviates from a desired value.

6 Claims, 12 Drawing Figures

LEARNING CONTROL SYSTEM FOR CONTROLLING AN AUTOMOTIVE ENGINE

BACKGROUND OF THE INVENTION

The present invention relates to a system for controlling the operation of an automotive engine, and more particularly to a learning control system for updating data stored in a table for controlling the fuel supply in an electronic fuel-injection system.

In one type of electronic fuel-injection control, for example the publication Japanese Patent Application Laid Open No. 57-122135, the amount of fuel to be injected into the engine is determined in accordance with engine operating variables such as mass air flow, engine speed and engine load. The amount of fuel is decided by a fuel injector energization time (injection pulse width). Basic injection pulse width ($T_p$) can be obtained by the following formula.

$$T_p = K \times Q/N \quad (1)$$

where Q is mass air flow, N is engine speed, and K is a constant.

Desired injection pulse width ($T_i$) is obtained by correcting the basic injection pulse ($T_p$) with engine operating variables. The following is an example of a formula for computing the desired injection pulse width.

$$T_i = T_p \times (COEF)\alpha \times K_a \quad (2)$$

Where COEF is a coefficient obtained by adding various correction or compensation coefficients such as coefficients of coolant temperature, full throttle open, engine load, etc., $\alpha$ is a $\lambda$ correcting coefficient (the integral of the feedback signal of an $O_2$-sensor provided in an exhaust passage), and $K_a$ is a correcting coefficient by learning (hereinafter called the learning control coefficient). Coefficients, such as the coolant temperature coefficient and engine load, are obtained by looking them up in tables in accordance with sensed information. The value of the learning control coefficient $K_a$ is obtained from a $K_a$-table in accordance with engine load. All of the coefficients $K_a$ stored in the $K_a$ -table are initially set to the same value, that is the number "1". This is caused by the fact that the fuel supply system is to be designed to provide the most proper amount of fuel without the coefficient $K_a$. However, very automobile can not be manufactured to have a desired function, resulting in the same result. Accordingly, the coefficient $K_a$ should be updated by learning in every automobile when it is actually used. If the difference between the initial value "1" and the updated value is large, hunting of the fuel injection system occurs. Heretofore, in order to prevent such a hunting, the initial value is incremented or decremented little by little until the value is entirely rewritten. Accordingly, a long time elapses before the value is updated, causing the delay of fuel control (FIG. 6*a*).

SUMMARY OF THE INVENTION

The object of the present invention is to provide a system which quickly operates to update a learning control coefficient and may prevent the hunting of a control system for a engine, such as an electronic fuel-injection system, whereby the engine operation can be properly controlled.

According to the present invention, there is provide provided a system for controlling an automotive engine by updated data, in which the data stored in a table is entirely updated the first time with an arithmetic average of feedback signal, and thereafter the data is incremented or decremented with a minimum storable value.

More particularly, the system comprises first means for detecting the operating condition of the engine and for producing a feedback signal dependent on the condition, second means for determining that the engine operating condition is in a state suitable for updating the data and for producing an output signal when this state occurs, third means for detecting the output signal of the second means, and for producing a first updating signal when the output signal of the second means did not exist before, and thereafter for producing second updating signals in accordance with the output signals of the second means. The arithmetic average of the data is updated with the feedback signal in accordance with the first updating signal, and thereafter the data is incremented or decremented with a minimum value in response to the second updating signal. The updating is continued until the feedback signal reaches a desired value.

In an aspect of the present invention, the second means comprises means for detecting a steady state of the engine operation for a predetermined period.

The other objects and features of this invention will become understood from the following description with reference to the accompanying drawings.

DETAILED DESCRIPTION OF THE PREFERRED EMBODIMENTS

Figure 1:
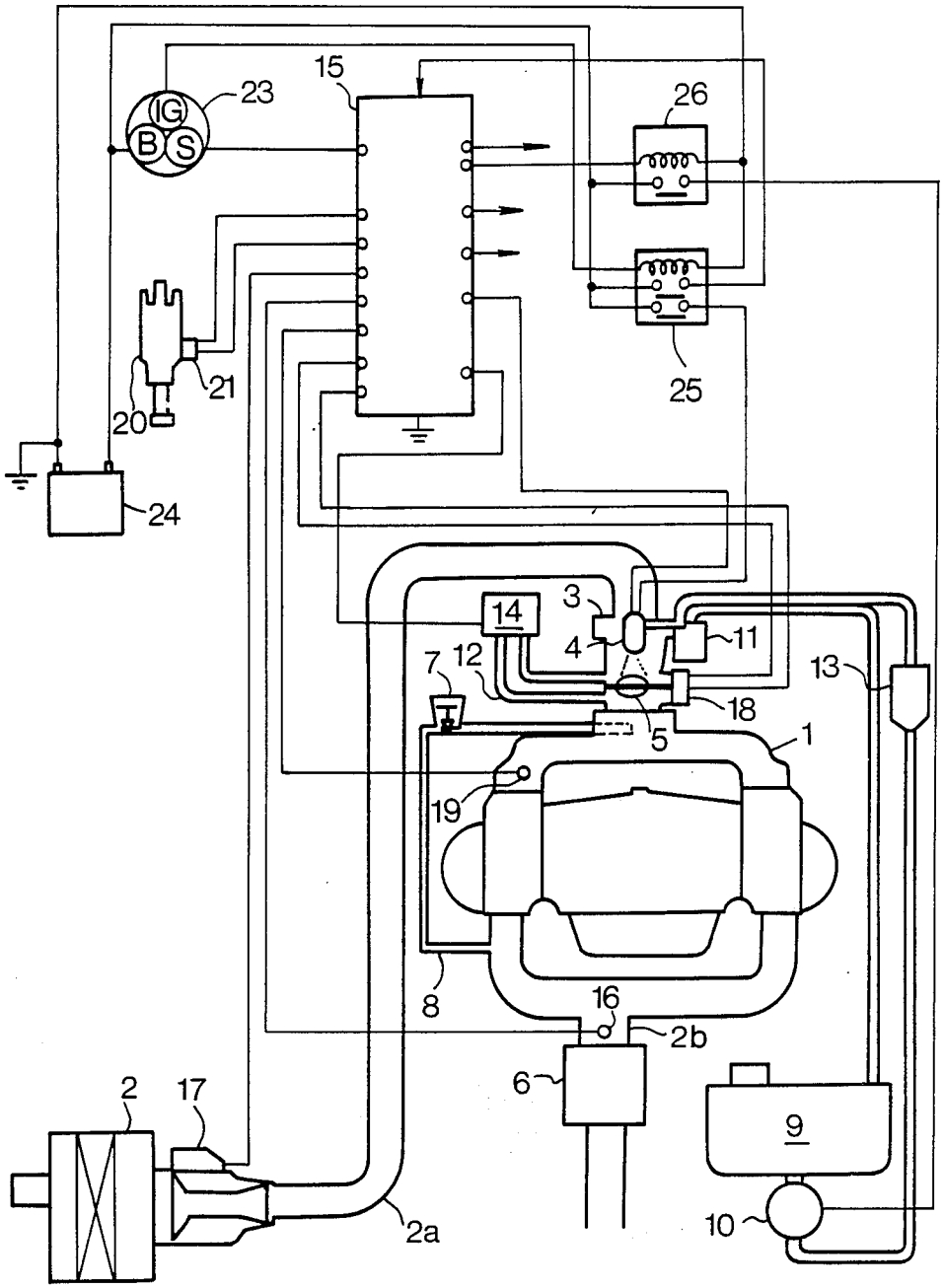
FIG. 1 is a schematic illustration showing a system for controlling the operation of an internal combustion engine for a motor vehicle.

Referring to FIG. 1, an internal combustion engine 1 for a motor vehicle is supplied with air through an air cleaner 2, intake pipe 2*a*, and throttle valve 5 in a throttle body 3, mixing with fuel injected from an injector 4. A three-way catalitic converter 6 and an $O_2$-sensor 16 are provided in an exhaust passage 2*b*. An exhaust gas recirculation (EGR) valve 7 is provided in an EGR passage 8 in a well known manner.

Fuel in a fuel tank 9 is supplied to the injector 4 by a fuel pump 10 through a filter 13 and pressure regulator 11. A solenoid operated valve 14 is provided in a bypass 12 around the throttle valve 5 so as to control engine speed at idling operation. A mass air flow meter 17 is provided on the intake pipe 2a and a throttle position sensor 18 is provided on the throttle body 3. A coolant temperature sensor 19 is mounted on the engine. Output signals of the meter 17 and sensors 18 and 19 are applied to a microcomputer 15. The microcomputer 15 is also applied with a crankangle signal from a crankangle sensor 21 mounted on a distributor 20 and a starter signal from a starter switch 23 which operates to turn on-off electric current from a battery 24. The system is further provided with an injector relay 25 and a fuel pump relay 26 for operating the injector 4 and fuel pump 10.

Figure 2:
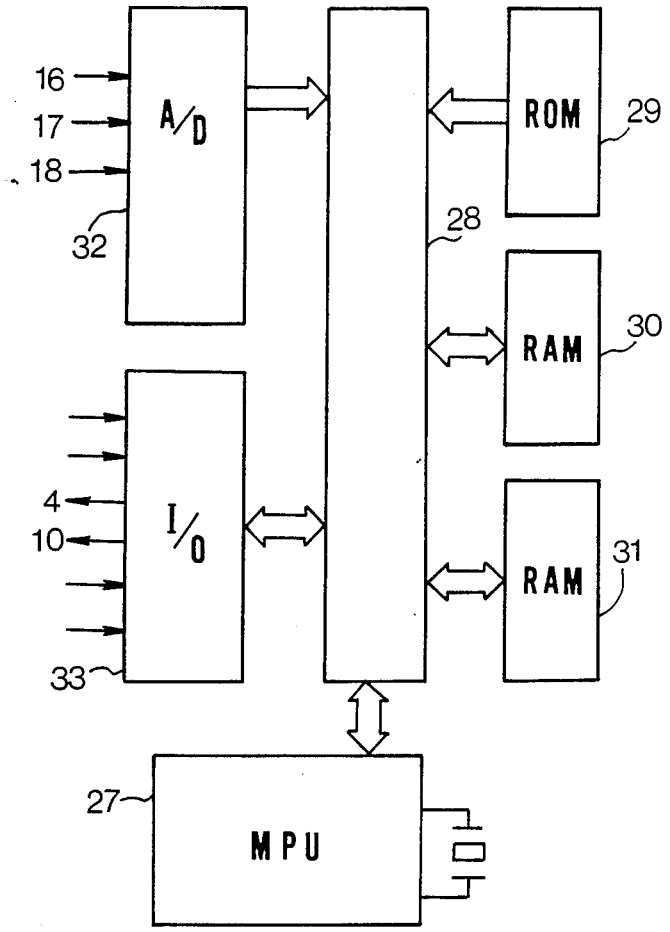
FIG. 2 is a block diagram of a microcomputer system used in a system of the present invention.

Referring to FIG. 2, the microcomputer 15 comprises a microprocessor unit 27. ROM 29, RAM 30, RAM 31 with back-up, A/D converter 32 and I/O interface 33. Output signals of $O_2$-sensor 16, mass air flow meter 17 and throttle position sensor 18 are converted to digital signals and applied to the microprocessor unit 27 through a bus 28. Other signals are applied to the microprocessor unit 27 through I/O interface 33. The microprocessor manipulates the input signals and executes the hereinafter described process.

Figure 3A:
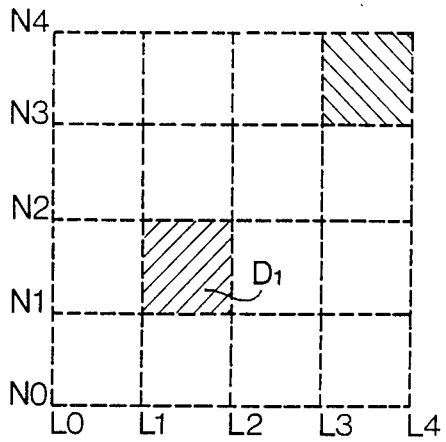
FIG. 3*a* is an illustration showing a matrix for detecting the steady state of engine operation.

In the system of the present invention, the learning control coefficients $K_a$ stored in a $K_a$-table are updated with data calculated during the steady state of engine operation. Accordingly, the detection of the steady state is necessary. In the system, the steady state is decided by ranges of engine load and engine speed and continuation of a detected state. FIG. 3a shows a matrix for the detection, which comprises, for example sixteen divisions defined by five row lines and five column lines. Magnitudes of engine load are set at five points $L_0$ to $L_4$ on the X axis, and magnitudes of engine speed are set at five points $N_0$ to $N_4$ on the Y axis. Thus, the engine load is divided into four ranges, that is $L_0$–$L_1$, $L_1$–$L_2$, $L_2$–$L_3$, and $L_3$–$L_4$. Similarly, the engine speed is divided into four ranges.

Figure 4A:
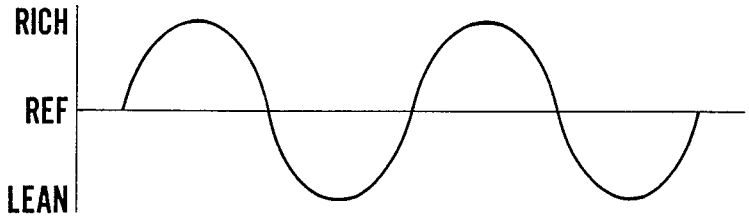
FIG. 4*a* shows the output voltage of an $O_2$-sensor.

On the other hand, the output voltage of the $O_2$-sensor 16 cyclically changes through a reference voltage corresponding to a stoichiometric air-fuel ratio, as shown in FIG. 4a. Namely, the voltage changes between high and low voltages corresponding to rich and lean air-fuel mixtures. In the system , when the output voltage (feedback signal) of the $O_2$-sensor continues during three cycles within the same one of the sixteen divisions in the matrix, the engine is assumed to be in steady state.

Figure 3B:
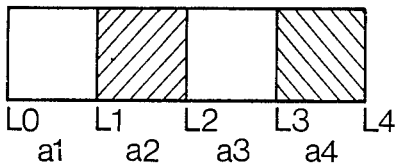
FIG. 3*b* shows a table for learning control coefficients.

FIG. 3b shows a $K_a$-table for storing the learning control coefficients $K_a$, which is included in the RAM 31 of FIG. 2. The $K_a$-table has addresses $a_1$, $a_2$, $a_3$, and $a_4$ which are corresponding to engine load ranges $L_0$–$L_1$, $L_1$–$L_2$, $L_2$–$L_3$, and $L_3$–$L_4$. As previously stated, each value stored in the table is "1" before driving a motor vehicle.

Figure 4B:
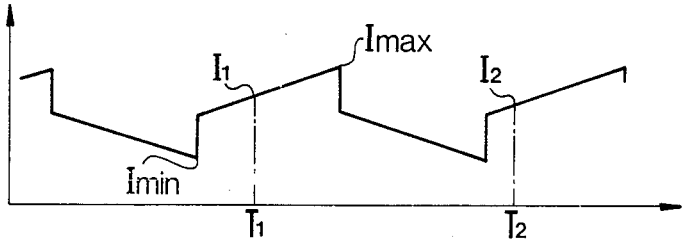
FIG. 4*b* shows the output voltage of an integrator.

Explaining the calculation of the injection pulse width ($T_i$ in formula 2) at starting of the engine, since the temperature of the body of the $O_2$-sensor 16 is low, the output voltage of the $O_2$-sensor is very low. In such a state, the system is adapted to provide "1" as the value of the correcting coefficient $\alpha$. Thus, the computer calculates the injection pulse width ($T_i$) from mass air flow (Q), engine speed (N), (COEF), $\alpha$ and $K_a$. When the engine is warmed up and the $O_2$-sensor becomes activated, the integral of the output voltage of the $O_2$-sensor at a predetermined time is provided as the value of $\alpha$. More particularly, the computer has a function of an integrator, so that the output voltage of the $O_2$-sensor is integrated. FIG. 4b shows the output of the integrator. The system provides values of the integration at a predetermined interval (40ms). For example, in FIG. 4b, integrals $I_1$, $I_2$—at times $T_1$, $T_2$ —are provided. Accordingly, the amount of fuel is controlled in accordance with the feedback signal from the $O_2$-sensor, which is represented by integral.

Explaining the learning operation, when steady state of engine operation is detected, the $K_a$-table is updated with a value relative to the feedback signal from the $O_2$-sensor. The first updating is done with an arithmetical average (A) of maximum value and minimum value in one cycle of the integration, for example values of Imax and Imin of FIG. 4b. Thereafter, when the value of $\alpha$ is not 1, the $K_a$-table is incremented or decremented with a minimum value ($\Delta A$) which can be obtained in the computer. Namely one bit is added to or subtracted from a BCD code representing the value A of the coefficient $K_a$ which has been rewritten at the first learning.

Figure 7A:
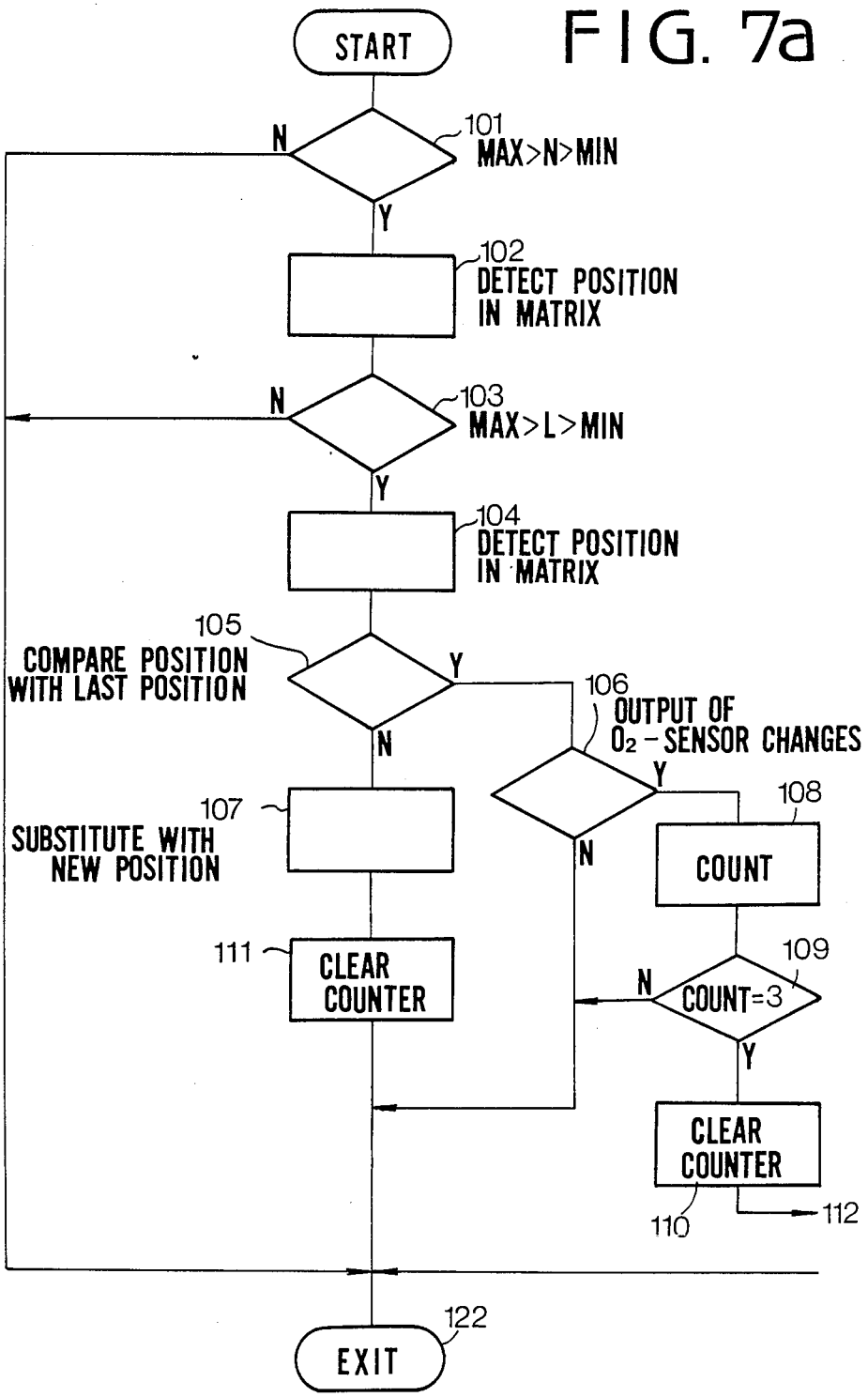
FIG. 7*a* and 7*b* are flowcharts showing the operation in an embodiment of the present invention.
Figure 7B:
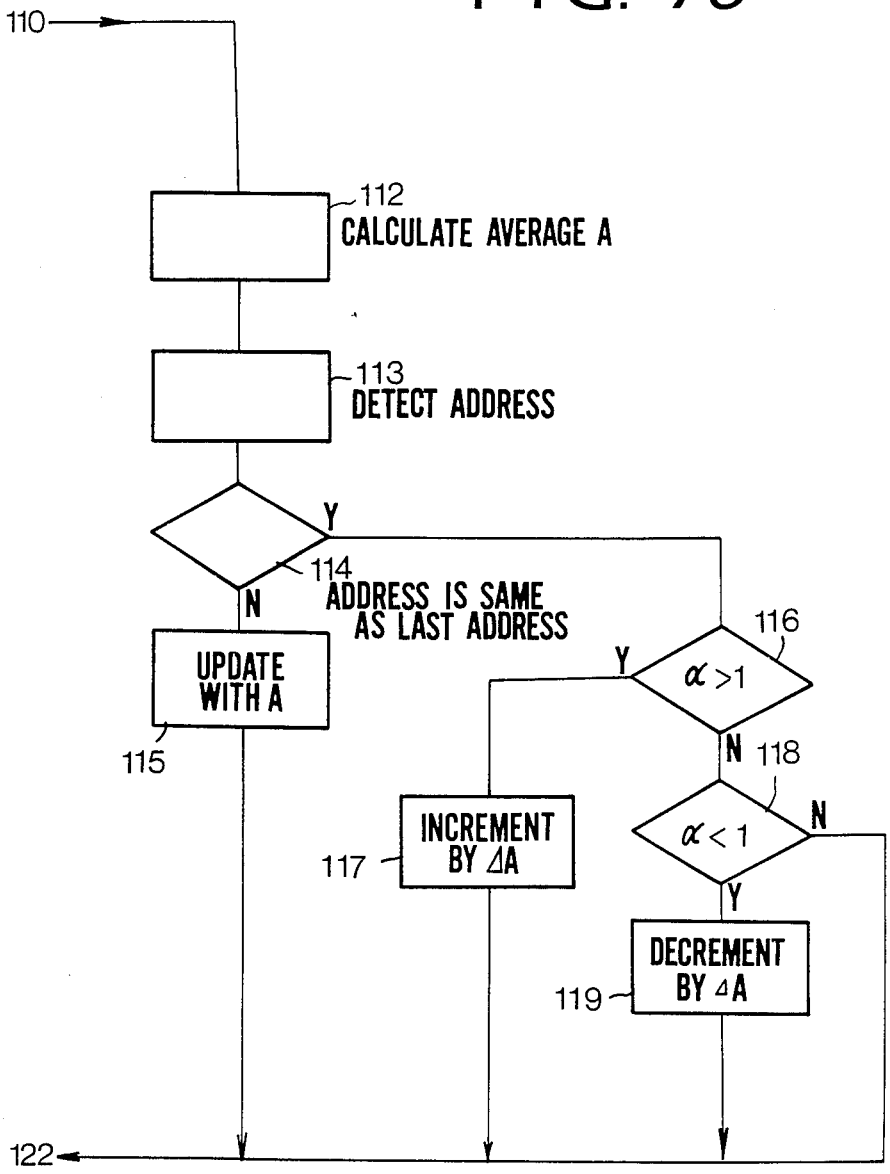

The operation of the system will be described in more detail with reference to FIG. 7a, 7b. The learning program is started at a predetermined interval (40 ms). At the first operation of the engine and the first driving of the motor vehicle, engine speed is detected at step 101. If the engine speed is within the range between $N_0$ and $N_4$, the program proceeds to a step 102. If the engine speed is out of the range, the program exits the routine at a step 122. At step 102, the position of the row of the matrix of FIG. 3a in which the detected engine speed is included is detected and the position is stored in RAM 30. Thereafter, the program proceeds to a step 103, where engine load is detected. If the engine load is within the range between $L_0$ and $L_4$, the program proceeds to a step 104. If the engine load is out of the range, the program exits the routine. Thereafter, the position of column corresponding the detected engine load is detected in the matrix, and the position is stored in the RAM. Thus, the position of the division corresponding to the engine operating condition represented by engine speed and engine load is determined in the matrix, for example, division $D_1$ is determined in FIG. 3a. The program advances to a step 105, where the determined position of the division is compared with the division which has been detected at the last learning. However, since the present learning is the first, the comparison can not be performed, and hence the program is terminated passing through steps 107 and 111. At the step 107, the position of the division $D_1$ is stored in a RAM.

At a learning after the first learning, the detected position is compared with the last stored position of division at step 105. If the position of the division in the matrix is the same as the last learning, the program proceeds to a step 106, where the output voltage of $O_2$-sensor 16 is detected. If the voltage changes from rich to lean and vice versa, the program goes to a step 108, and if not, the program is terminated. At the step 108, the number of the cycle of the output voltage is counted by a counter. If the counter counts up to three, the program proceeds to a step 110 from a step 109. If the count does not reach three, the program is terminated. At the step 110, the counter is cleared and the program proceeds to a step 112.

On the other hand, if the position of the division is not the same as the last learning, the program proceeds to step 107, where the old data of the position is substituted with the new data. At the step 111, the counter which has operated at step 108 in the last learning is cleared.

At step 112, the arithmetical average A of maximum and minimum values of the integral of the output voltage of the $O_2$-sensor at the third cycle of the output waveform is calculated and the value A is stored in a RAM. Thereafter, the program proceeds to a step 113, where the address corresponding to the position of division is detected, for example, the address $a_2$ corresponding to the division $D_1$ is detected and the address is stored in a RAM to set a flag. At a step 114, the stored address is compared with the last stored address. Since, before the instant learning, no address wase stored, the program proceeds to a step 115. At step 115, the learning control coefficient $K_2$ in the address of the $K_a$-table of FIG. 3*b* is entirely updated with the new value A that is the arithmetical average obtained at step 112.

At a learning after the first updating, if the address detected at the process 114 is the same as the last address, (the flag exists in the address) the program proceeds from step 114 to a step 116, where it is determined whether the value of $\alpha$ (the integral of the output of the $O_2$-sensor) at the learning is greater than "1". If the $\alpha$ is greater than "1", the program proceeds to a step 117, where the minimum unit $\Delta A$ (one bit) is added to the learning control coefficient $K_a$ in the corresponding address. If the $\alpha$ is less than "1", the program proceeds to a step 118, where it is determined whether the $\alpha$ is less than "1". If the $\alpha$ is less than "1", the minimum unit $\Delta A$ is subtracted from $K_a$ at a step 119. If the $\alpha$ is not less than "1", which means that the $\alpha$ is "1", the program exists the updating routine. Thus, the updating operation continues until the value of the $\alpha$ becomes "1".

Figure 5:
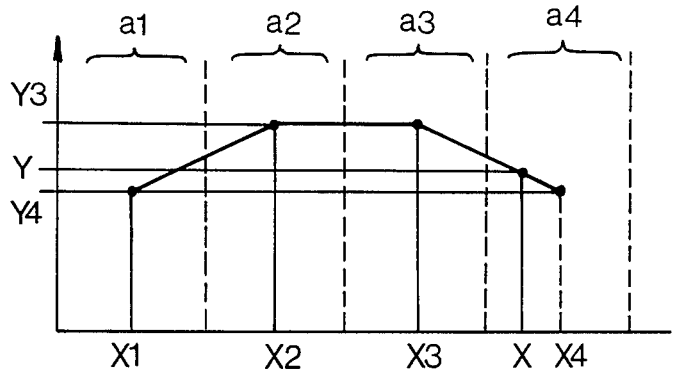
FIG. 5 shows a linear interpolation for reading the table of FIG. 3*b;*

When the injection pulse width ($T_i$) is calculated, the learning control coefficient $K_a$ is read out from the $K_a$-table in accordance with the value of engine load L. However, values of $K_a$ are stored at intervals of loads. FIG. 5 shows an interpolation of the $K_a$-table. At engine loads $X_1$, $X_2$, $X_3$, and $X_4$, updated values $Y_3$ and $Y_4$ (as coefficient $K_a$) are stored. When the detected engine load does not coincide with the set loads $X_1$ to $X_4$, coefficient $K_a$ is obtained by linear interpolation. For example, value Y of $k_a$ at engine load X is obtained by the following formula.

$$Y=((X-X_3)/(X_4-X_3))\times(Y_4-Y_3)+Y_3$$

Figure 8:
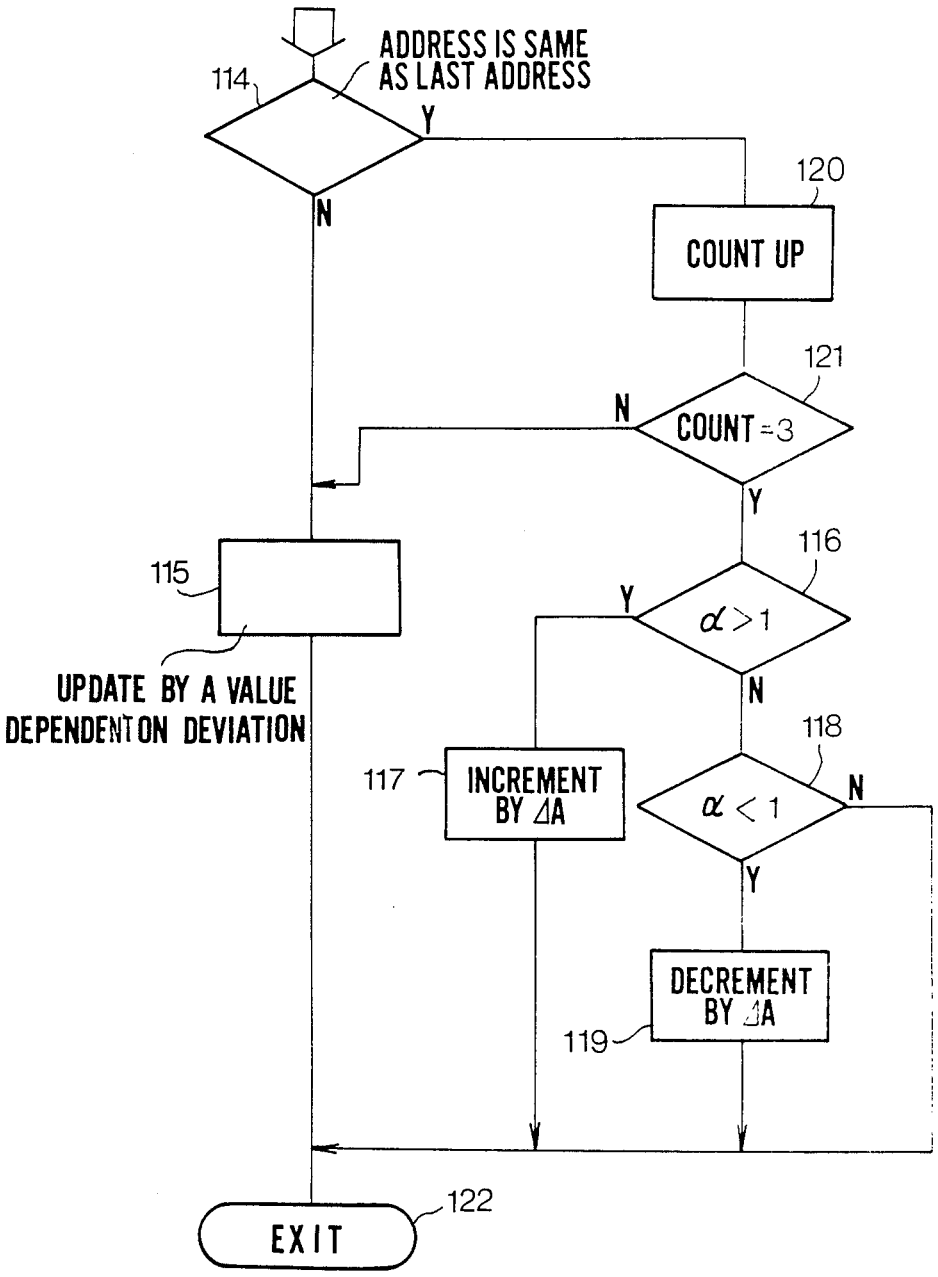
FIG. 8 is a flowchart of the operation in another embodiment.

Referring to FIG. 8 showing another updating routine, in the system, the first updating is stepwisely performed with a value smaller than the arithmetical average A until the value of the table reaches a value approximately equal to the desired value A. After the first updating, the updating of the table is performed in the same manner as the program of FIG. 7*b*.

More particularly, at step 114, if the flag does not exist in the address, the program proceeds to a step 115, where the learning control coefficient $K_a$ is updated by a value dependent on the deviation of the feedback signal of the $O_2$-sensor, for example a value V expressed by the following formula.

$V=D\times M+1$, where D is the difference between the arithmetic average A and the desired value "1", M is an arbitrary number less than "1", for example, 0.2, 0.5 . . . At the next learning control operations, the program proceeds from step 114 to a step 120, where the number of the operation is counted up. At a step 121, the counted number is decided. When the number is smaller than three, the program proceeds to step 115, where the value V is added to the prior value. When the counter counts up to three, the program proceeds to the step 116, where the same operation as in FIG. 7*b* is performed.

Although the above described embodiments relate to fuel injection systems, the present invention can be applied to control systems other than the fuel injection system.

Figure 6A:
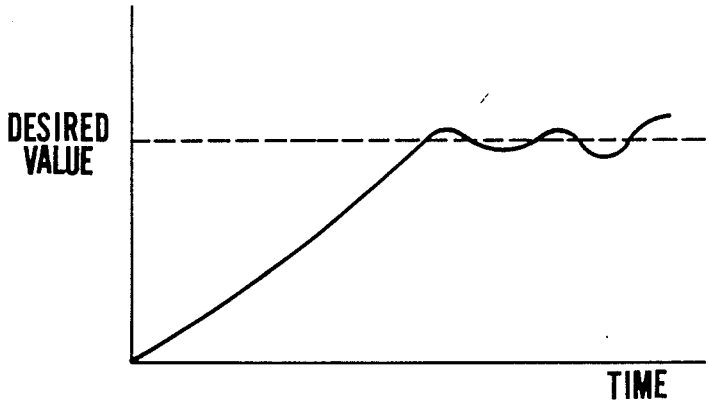
FIG. 6a PRIOR ART
FIGS. 6*a* and 6*b* are graphs showing variations of learning control coefficients in a conventional system and a system of the present invention.
Figure 6B:
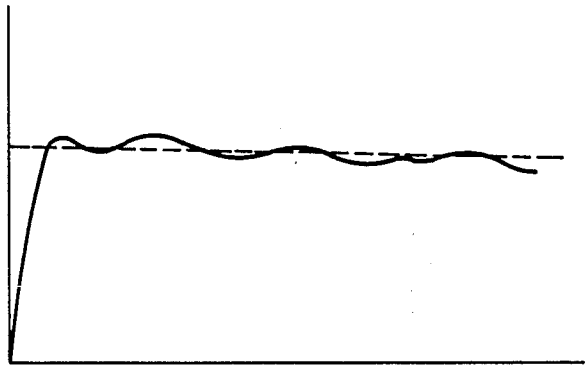

In accordance with the system of the present invention, data in a table is largely updated by a value relative to the feedback signal at the first updating occurrence, and, after the first updating, the data is updated little by little as shown in FIG. 6*b*. Thus, the engine operation is properly controlled without hunting of the system.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A system for updating data in an apparatus for controlling air-fuel ratio in an automotive engine by the updated data, the system comprising:

a table for storing data;

first means for detecting an operating condition of the engine and for producing a feedback signal dependent on the condition;

the apparatus comprising means for controlling the air-fuel ratio dependent on said feedback signal and on currently prevailing of the data in the table;

said system further comprising:

second means for determining that the engine (operating condition) is in a state suitable for updating the data stored in the table and for producing an output signal at the first occurrence of the state;

third means for detecting the output signal and for producing a first updating signal when the output signal did not exist before, and respectively for producing a second updating signal in accordance with the output signals after the first occurrence of said output signal;

fourth means responsive to the first updating signal for updating the data in the table with new value dependent on the feedback signal;

fifth means responsive to the second updating signal for incrementing and decrementing the data in the table with a minimum incremental value of one bit; and sixth means for continuing the operation of the fifth means until the feedback signal reaches a desired value.

2. A system for updating data in an apparatus for controlling air-fuel ratio in an automotive engine by the updated data, the system comprising:

a look-up table for storing data with respect to at least one operating condition of the engine; and first means for detecting an operating condition of the engine and for producing a feedback signal dependent on the latter operating condition;

the apparatus comprising means for controlling the air-fuel ratio dependent on said feedback signal and on the currently prevailing of the data in the look-up table;

said system further comprising:

second means for determining that engine operation is in steady state by determining that two variables of engine operation stay in one of divisions of a matrix for a predetermined period, the matrix being formed by the two variables of engine operation, said second means for producing an output signal when the steady state is so determined;

third means for detecting said output signal and for producing a first updating signal when said output signal did not occur before, and respectively for producing a second updating signal in response to occurrence of the output signal after a first occurrence of said output signal;

fourth means responsive to the first updating signal for completely updating the data in the table stored with respect to said at least one operating condition of the engine with a value dependent on an arithmetical average of the feedback signal;

fifth means responsive to the second updating signal for incrementing and respectively decrementing the data stored in the table with a minimum value capable of storing in said table; and sixth means for continuing the operation of the fifth means until the feedback signal reaches a desired value.

3. The system according to claim 2, wherein said at least one operating condition of the engine is one of said two variables of engine operation.

4. The system according to claim 2, wherein said fifth means being responsive to the second updating signal for incrementing and respectively decrementing the data, stored in the table corresponding to a prevailing of said at least one operating condition of the engine, with said minimum value capable of storing.

5. The system according to claim 2, wherein said value dependent on said arithmetical average of the feedback signal is an arithmetical average of maximum and minimum values in one cycle of an integral of said feedback signal.

6. The system according to claim 5, wherein said fifth means is further responsive to said integral of said feedback signal such that when said integral is greater and smaller than a predetermined value said incrementing and respectively decrementing occur.

* * * * *